US008276835B2

(12) United States Patent
Lowry et al.

(10) Patent No.: US 8,276,835 B2
(45) Date of Patent: Oct. 2, 2012

(54) AEROSOL PRODUCT COMPRISING AN AQUEOUS COMPOSITION

(75) Inventors: Michael Richard Lowry, Wirral (GB); Joseph Muscat, Wirral (GB); John Noel Ruddock, Wirral (GB); Thomas Edward Shearmur, Hook (GB); Simon Andrew Watson, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 620 days.

(21) Appl. No.: 12/231,475

(22) Filed: Sep. 3, 2008

(65) Prior Publication Data

US 2009/0057447 A1 Mar. 5, 2009

(30) Foreign Application Priority Data

Sep. 5, 2007 (EP) ..... 07115690

(51) Int. Cl.
*B05B 1/34* (2006.01)

(52) U.S. Cl. ..... 239/492; 239/468; 239/472; 239/475; 239/487

(58) Field of Classification Search ..... 239/463, 239/468, 472, 474, 475, 482, 487, 488, 501, 239/494, 496, 492

See application file for complete search history.

(56) References Cited

U.S. PATENT DOCUMENTS

| | | | | |
|---|---|---|---|---|
| 2,767,023 | A * | 10/1956 | Venus, Jr. | 239/491 |
| 3,240,431 | A * | 3/1966 | Hug et al. | 239/589.1 |
| 3,881,658 | A * | 5/1975 | Greenebaum et al. | 239/492 |
| 4,071,196 | A | 1/1978 | Burke et al. | 239/492 |
| 4,583,692 | A * | 4/1986 | Sheffler et al. | 239/405 |
| 5,711,488 | A * | 1/1998 | Lund | 239/333 |
| 2001/0011687 | A1 | 8/2001 | Benoist | 239/492 |
| 2004/0099697 | A1* | 5/2004 | Woods | 222/402.1 |

FOREIGN PATENT DOCUMENTS

| | | |
|---|---|---|
| GB | 2 154 473 | 9/1985 |
| WO | 97/13584 | 8/1997 |

OTHER PUBLICATIONS

PCT International Search Report in PCT application PCTEP 2008/060407.

EP Search Report in EP application EP 07 11 5690.

* cited by examiner

*Primary Examiner* — Jason Boeckmann
(74) *Attorney, Agent, or Firm* — Karen E. Klumas

(57) ABSTRACT

The design of the spray nozzle in an aerosol dispenser controls the characteristics of the spray that is produced. In a nozzle that comprises the elements of a multiplicity of inlet channels leading to a swirl chamber and an outlet orifice, the perception of wetness of a spray, such as an aqueous alcoholic deodorant spray, can be reduced by dimensioning the respective elements so that the sum of the widths of the inlet channels is less than the diameter of the swirl chamber and at least 1.5 times the diameter of the outlet orifice and the outlet orifice has a diameter of at least 0.3 mm together with the inlet channels being short, such as less than 0.5 mm. The new nozzle is especially suitable for spraying compositions having a low volatile organic carbon content and compositions comprising a significant proportion of water.

32 Claims, 12 Drawing Sheets

AEROSOL PRODUCT COMPRISING AN AQUEOUS COMPOSITION

The present invention relates to aerosols and in particular to improvements in or relating to the spray nozzle of aerosol dispensers, to a spray dispenser incorporating such a spray nozzle, a product comprising a sprayable liquid, especially cosmetic liquids, within such a spray dispenser and a process for spraying.

Hand-held aerosols comprise a reservoir for a sprayable fluid, a valve in fluid communication with the reservoir to control flow of liquid, an actuator that can be engaged with the valve to open and close it and a spray nozzle in fluid communication with the valve, commonly via a spray channel within the actuator. The spray nozzle, sometimes called an insert, is an important component of the aerosol dispenser because it generates the spray of liquid droplets emanating from the dispenser. Variation in the spray nozzle configuration can accordingly lead to changes in the pattern of droplets, their size and distribution and furthermore to changes in the perception by the user of the attributes of the spray, otherwise sometimes expressed as sensory characteristics. Such characteristics are of considerable importance, because they are a major contributor to whether the user likes the product and whether it will be purchased again.

Some commercially available aerosol dispensers employ a spray nozzle which comprises a multiplicity of liquid inlet channels directing liquid tangentially into a swirl chamber and thence out through an outlet orifice. The swirl chamber approximates to circular in axial cross section. The dimensions of each stage of the nozzle are important in determining the eventual spray characteristics, including not only the width of the inlet channels, and the diameter of the swirl chamber and outlet orifice, but also the relative length of the inlet channel to the swirl chamber diameter. In a typical example of such a configuration, the sum of the width of the spray channels exceeds the diameter of the swirl chamber, such as 1.5 times the diameter and the diameter of the swirl chamber exceeds the diameter of the outlet orifice similarly and the inlet channels are comparatively long, so that the ratio of the inlet channel length to swirl chamber diameter is low. In that configuration, the size of the fluid/gas passage falls progressively from inlet channels (measured as their total width) through the diameter of the swirl chamber diameter and finally to the diameter of the outlet orifice. In such nozzles, investigations into the habits of consumers have found that the resultant spray can be perceived as being wet, for example when employing a commonly used deodorant base. That perception is particularly strong when an aqueous composition is being sprayed, but can apply also to alcoholic compositions as well. Many consumers would prefer their spray not to be so wet, or, to express it differently, prefer for them not to perceive wetness to the same extent.

Environmental concerns are becoming increasingly important. One way of reducing the emission of greenhouse gasses is to employ aqueous compositions, but these tend to be perceived as wet. Thus, it is particularly desirable to devise a nozzle that can reduce the perception of wetness especially from aqueous compositions, and thereby advance the introduction of aerosol products containing aqueous compositions.

Nozzles for insertion in aerosol spray outlets have been described in a number of prior publications. Thus, for example Frank Venus describes in U.S. Pat. No. 2,767,023, i.e. in the early days of hand-held aerosol dispensers, a design that has been adopted as a conventional nozzle, namely a nozzle having a small swirl chamber and a plurality of long inlet channels. Subsequently, though James E Burke in U.S. Pat. No. 4,071,196 modifies the shape of the annular channel that feeds the plurality of inlet channels, and also tapers the inlet channels, he likewise contemplates comparatively long inlet channels and a small swirl chamber diameter. Similarly, although Revlon in GB 2154473 advocate the addition of a second feed conduit, it is once again in the context of a nozzle having a small diameter swirl chamber and a comparatively long inlet channel.

In US2001/0011687, Jean Francois Benoist proposed ranges for selecting the ratio of inlet channels area, swirl chamber diameter and outlet orifice diameter, but he did so whilst still employing long inlet channels, as in conventional spray nozzles. Accordingly, Benoist does not direct the reader to the combination of the instant invention which not only controls the widths and diameters of the inlet channel, swirl chamber and outlet orifice, but significantly employs a short inlet channel.

In WO97/13584, Procter & Gamble, though allegedly not bound by any particular theory, then proceeded to describe a theory that linked the vane (sic inlet channel) exit and entry widths to the (sic swirl) chamber diameter. Once again, the applicants fail to recognise the significance of the length of the inlet channels and describe conventional long inlet channels.

It is an object of the present invention to devise a spray nozzle which generates a modified spray pattern.

It is a further object of at least some embodiments of the present invention to devise a spray nozzle which generates a spray perceived to be less wet.

It is a yet further object of some or other embodiments of the present invention to devise a spray nozzle that is well suited to spraying aqueous compositions.

Other and still further objects may be discernible from the text below.

BRIEF SUMMARY OF THE PRESENT INVENTION

According to one aspect of the present invention, there is provided an improved spray nozzle for an aerosol dispenser comprising a swirl chamber in fluid communication with a plurality of non-radial inlet channels and an outlet orifice dimensioned and arranged so as enable improved swirl in the chamber before discharge of fluid passing through the nozzle. In one expression, such improved swirl in the chamber can be provided by forming the spray nozzle elements such that the sum of the widths of the inlet channels at its trailing side on entry into the swirl chamber is less than the diameter of the swirl chamber and at least 1.5 times the diameter of the outlet orifice.

Herein, the width of the inlet channel is that which is measured orthogonally to its trailing side. Herein, the tangential inlet channel causes fluid introduced through it into the swirl chamber to circulate clockwise or anticlockwise depending on which way the channel is inclined to radial. The leading and trailing sides of the channel are determined in the same direction as the direction of flow of fluid in the swirl chamber, as is apparent from FIG. 1 herein.

In a second expression, the relatively improved nozzle generating improved spray characteristics is achieved by dimensioning the swirl chamber and outlet orifice to increase their relative diameters, such as to above 2.5:1 and particularly above 3:1.

In a third expression, the relatively improved spray characteristics in the invention nozzle is achieved by selecting the ratio of radial length of the inlet channel to the diameter of the swirl chamber in the range of from 2:5 to 2:15.

The radial length of the inlet channel herein is the length measured along the radius between the outer circumference of the swirl chamber and the inner circumference of the annular feed channel in communication with the inlet channel.

By configuring the spray nozzle in one or more of such expressions, and particularly when all of them are adopted in combination, it is possible to improve the nature of the flow pattern of fluid, including gas from propellant, as it swirls within the spray chamber, thereby altering the spray characteristics and reducing the perception of wetness felt by consumers. Without being bound by any particular theory, it is believed that the selection of the nozzle in accordance with the various characteristics of the inlet channels, swirl chamber and outlet orifice in the manner described herein alters beneficially the velocity components of the liquid in the fluid passing through the nozzle. The instant invention provides express teaching on how to achieve the objective of reducing wetness or the perception of wetness felt by consumers, which can be most apparent when spraying aqueous compositions.

According to a second aspect of the present invention there is provided an aerosol dispenser comprising a reservoir for a sprayable fluid, a spray nozzle according to the first aspect, a valve in fluid communication with the reservoir and the spray nozzle and an actuator for the valve.

According to a third aspect of the present invention, there is provided an aerosol product comprising a sprayable fluid contained within the reservoir of the aerosol dispenser according to the second aspect.

According to a fourth aspect, there is provided a process for spraying in which a sprayable fluid is sprayed from a dispenser according to the second aspect.

DETAILED DESCRIPTION AND PREFERRED EMBODIMENTS

The present invention is directed towards altering the configuration of the spray nozzle comprising a plurality of channels feeding fluid non-radially into a swirl chamber and thence discharge through an outlet orifice of reduced diameter compared with the swirl chamber.

An important contribution towards altering the spray characteristics, and thereby altering the sensory perception of the spray, can be provided by altering the relative diameter of the swirl chamber to the dimensions of the inlet channels. Depending on the way in which such alteration is made, such an alteration can also advantageously increase the ratio of the diameter of the swirl chamber to the outlet orifice. The dimensional relationship between the inlet channels and the swirl chamber is subject to variations in the diameter of the swirl chamber and variations in the size, number and radial length of the inlet channels.

The number of inlet channels is at least two, such as two or three, or conveniently in the range of from 4 to 8, such as from 4 to 6. Each channel often is identical, subject as usual to minor variations which can arise in moulding operations. Advantageously, in some embodiments, the channels are disposed symmetrically, desirably point symmetry. In other embodiments, the inlet channels are disposed asymmetrically.

The inlet channels usually have a width of from 0.1 to 0.3 mm and in many embodiments a width selected in the range of from 0.1 to 0.25 mm. For use in hand-held aerosols, the sum of the widths of the inlet channels in spray nozzles according to the present invention is often selected within the range of from 0.6 or 0.75 to 1.5 mm, and especially from 0.75 to 1.25 mm. The inlet channels, can be, if desired, inwardly tapered, for example tapering by up to half. In this context, inward indicates towards the swirl chamber.

It is especially convenient for the inlet channels to have flat leading and trailing sides. This can provide channels with a rectangular or square-cross section. Commonly, the inlet channels have a constant depth, which in many desirable embodiments is the same as the swirl chamber. Although that is a particularly convenient arrangement, it is possible to contemplate inlets that are not as deep as the swirl chamber, and in such arrangements its width is deemed to be reduced by the depth reduction. For example, if the depth were reduced by 20%, then the width for the purposes of this invention in calculating the relationship between the channels and the swirl chamber would be deemed likewise to be 20% smaller. For tapered or reduced depth inlet channels, the width for comparison with the diameter of the swirl chamber is measured at the point of entry into the swirl chamber, and is orthogonal to the axis of the channel, which is taken to be parallel with the trailing side. In some embodiments, it is advantageous to employ 4, 5 or especially 6 inlet channels, such as each having a width (determined on entry to the swirl chamber) of from 0.125 to 0.15 mm. In other desirable embodiments it is more convenient to employ only 2 or 3 inlet channels, and in such embodiments, it is practical to select comparatively wide inlet channels (e.g. 0.25 to 0.3 mm) together with a comparatively narrow outlet orifice, e.g. 0.3 to 0.45 or 0.3 to 0.39 mm.

The inlet channels enter the swirl chamber non-radially, previously described as tangentially in the specification lodged with the priority application. By the term non-radially herein is meant that the inlet channel encounters the periphery of the swirl chamber at an acute angle to the radius of the chamber, as determined by the orientation of the trailing side of the inlet channel to the swirl chamber. The acute angle between that trailing side and radial is usually within the range of from 15 to 50° and in many embodiments from 20 to 40°. In nozzles according to the instant invention, the angle between the leading side of the inlet channel and radial is usually at least 45° and up to 90°, and more conveniently up to 75°. When the inlet channel is tapered towards the swirl chamber, the angle for the leading side tends to be at the lower end of the range, such as from 45 to 55°, and the angle for the trailing edge tends to be towards the upper end of the range such as above 40°, whereas if the inlet channel is parallel sided, the angle for the leading side tends to be at the higher end of the preferred range, such as from 55 to 75°, and the angle for the trailing edge tends to be towards the lower end of the range such as from 25 to 35°.

The inlet channels in the instant invention are short in relation to the diameter of the swirl chamber in order to achieve the spray having desirable sensory properties, and especially an aqueous spray having a reduced perception of wetness. Short herein indicates that the ratio of radial length of the inlet channel to the diameter of the swirl chamber into which it feeds fluid non-radially, causing swirling within the chamber, is no greater than 2:5. Aerosol spray nozzles are currently normally made by moulding a thermoplastic, and this tends to impose a minimum practical radial length of the inlet channel. In practice, the ratio of the radial length to the diameter of the swirl chamber is usually not less than 2:15. It is desirable for the ratio of diameter to radial length to be from or greater than 3:1 and in some preferred embodiments from or greater than 4:1. It is convenient for the said ratio to be up to or less than 13:2 and in at least some especially desirable embodiments is up to or less than 6:1. Ratios which warrant exemplification include 9:2, 5:1 and 11:2.

The radial length of the inlet channel is normally less than 0.52 mm, often less than 0.5 mm and for practical reasons is usually at least 0.25 mm and in many embodiments at least 0.27 mm. The radial length in some preferred invention nozzles is at least 0.3 mm, such as particularly at least 0.32 mm. The radial length is advantageous up to 0.42 mm and in some well liked nozzles is up to 0.37 mm.

The employment of inlet channels of short length in the instant invention enable the inlet channels to be spaced apart to a greater extent around the periphery of the swirl chamber than if a long inlet channel were employed. This benefit increases with the number of inlet channels employed and particularly when at least 5 inlet channels are employed. For 4 or less inlet channels, it is comparatively easy to space inlet channels apart even if long inlet channels are employed.

The various dimensions of the inlet channel are particularly suited for employment with the dimensions of the swirl chamber and outlet orifice given herein to generate spray with highly desirable sensory properties.

The swirl chamber conveniently has an internal diameter within the range of from 1 to 2.5 mm, especially at least 1.25 mm and particularly at least 1.5 mm or especially at least 1.75 mm. An internal diameter of up to 2.25 mm is well favoured. Selection within such ranges of diameters can enable highly desirable ratios to the radial length of the inlet channels to be attained. In some favoured embodiments, the swirl chamber has a diameter of from 1.75 to 2.25 mm. It will be recognised that such a diameter range is larger than in at least some spray nozzles available for hand-held aerosols, or that the inlet channels were significantly longer, so that, accordingly, this can permit the achievement simultaneously of decreasing the ratio of the dimensions of the spray inlets to the swirl chamber and increasing the ratio of diameters of the swirl chamber to the outlet orifice, which is a particularly desirable combination in order to alter the spray characteristics of the resultant spray. Such an increase in swirl chamber diameter facilitates the provision of spray nozzles in which the diameter of the swirl chamber is greater than the sum of widths of the inlet channels. In a number of desirable embodiments according to the present invention, the ratio of the swirl chamber diameter to the sum of the widths of the inlet channel is greater than 1.2:1, particularly greater than 1.3:1 and preferably greater than 1.5:1. Said ratio is conveniently up to 3:1 and an especially preferred ratio is in the range of from 2:1 to 3:1, such as from 2.25:1 to 2.75:1.

It will be recognised that the ratio is obtained by suitable selection of the dimensions of the swirl chamber and the inlet channels. It is very desirable to select dimensions such that the swirl chamber has a diameter of from 1.5 to 2.5 mm and preferably 1.7 to 2.25 mm, such as about 2 mm, providing a ratio to the inlet channels' summed width of greater than 1.5:1, and especially from 2:1 to 3:1, such as from 2.25:1 to 2.75:1.

The depth of the swirl chamber is conveniently selected in the range of from 0.15 mm, and often from 0.2 mm, up to 1 mm, commonly up to 0.5 mm and in many desirable embodiments from 0.225 mm to 0.35 mm or 0.3 mm. The swirl chamber commonly has a circular peripheral side extending axially between the entry of inlet channels and a constant cross section orthogonal to its axis. The volume of the swirl chamber is often selected in the range of from 0.4 to 1.5 $mm^3$, and is particularly selected in the range of from 0.7 to 11.0 $mm^3$.

The outlet orifice in spray nozzles according to the present invention often has a diameter of below 0.75 mm, and in many spray nozzles, at least 0.35 mm. In many convenient spray nozzles, the diameter of the outlet orifice is below 0.625 mm. In some invention spray outlets, the outlet orifice diameter is selected in the range of up to 0.39 mm, such as from 0.3 to 0.39 mm. Such dimensions are well suited to spraying at a low or very low discharge rate. In other spray nozzles according to the present invention, the outlet orifice diameter is from 0.4 to 0.6 mm, which is especially convenient because orifices with such a diameter are readily formable, and by selection of appropriate inlet channel dimensions enables a desirable spray discharge rate to be obtained. Conveniently the outlet orifice is co-axial with the swirl chamber.

The outlet orifice conveniently has a length (sometimes called land length) of at least 0.3 mm, such as up to 0.7 mm, and is normally up to 0.6 mm. In many instances, its land length is between (i.e. from, to) 0.3 and 0.4 mm. The outlet orifice can, if desired, be cylindrical or, in some particularly desirable embodiments, can be frustoconical, having a cone angle that desirably is suited to spraying onto a surface, such as human skin at a distance of from 12 to 18 cms, 15 cms being recommended. Such a cone angle is advantageously below 40°, preferably above 20 or 25° and in several well-liked embodiments is between 30 and 36°.

The ratio of the diameter of the swirl chamber to the outlet orifice is advantageously above 2.5:1, particularly above 3:1 and in some very convenient embodiments is at least 4:1.

Such ratio is very preferably below 10:1 and in many highly desirable embodiments is below 7:1, such as up to 20:3. In a number of embodiments embodying very convenient dimensions of both the swirl chamber and the outlet orifice, the ratio of their diameters is from 4:1 to 6:1.

It is particularly desirable to employ a swirl chamber having a depth of from 0.225 to 0.3 mm and a diameter of from 1.5 to 2.25 mm in conjunction with an outlet orifice having a diameter of from 0.35 to 0.6 mm.

A particularly advantageous dimensions profile is for the diameter of the swirl chamber to be greater than the sum of the inlet channel widths and significantly, but not excessively greater than that of the outlet orifice. It is highly desirable for the diameter of the outlet orifice to be noticeably lower than the sum of the inlet channel widths. A desirable ratio of those two dimensions is from 1.75: to 4:1, and in many highly desirable embodiments up to 10:3.

It is very convenient for the spray nozzle to be formed as a one-piece moulding. Such a moulding is desirably cup-shaped comprising a tubular circular wall closed at one end by an end wall indented to the depth of the swirl chamber and inlet channels, from which extend outwardly, and desirably centrally, a tubular outlet orifice. The moulding is typically of a thermoplastic such as polyethylene or polypropylene, and especially is formed by injection moulding. Conveniently, for incorporation in a hand-held aerosol, the circular wall has an internal diameter of at least 2.5 mm and commonly not greater than 4 mm, and in many embodiments up to 3.5 mm. A preferred range is such as from 2.75 to 3.25 mm. It is desirable to mould the nozzle such that the ratio of the internal diameter of the circular wall and the external diameter of the swirl chamber is from 1.5:1 to 2.5:1 and especially up to 2:1. The end wall internally abuts a cooperating peg in an actuator spray channel, closing the swirl chamber and inlet channels on their inward side, and defining with the circular side wall of the nozzle an annular channel linking the inlet channels with the spray channel in the actuator. In this context, inward indicates the face of the swirl chamber opposite to that of the outlet orifice.

The annular channel is usually co-axial with the swirl chamber and outlet orifice. It often has a radial width of at least 0.5 mm and particularly up to 1 mm. This often translates to the inner periphery of the annular channel having a diameter selected in the range of from 2.1 to 3.1 mm, such as at least 2.25 mm and additionally or alternatively up to 2.75 mm. The nozzle can conveniently be retained within, and at the outlet end of, the actuator spray channel by friction, optionally assisted by a radially extending rib, preferably adjacent to the inward open mouth of the nozzle.

By so dimensioning the housing and swirl chamber, it is possible to achieve a spray nozzle with relatively short inlet channels and provide a high ratio of the diameter of the swirl chamber to the outlet orifice.

By selection of the dimensions of the spray nozzle, in conjunction with can pressure and the characteristics of the fluid being sprayed, including its density and viscosity, it is possible using the invention to obtain a spray having desirable characteristics at a spray rate of from 0.3 to 0.5 or 0.6 $gs^{-1}$, particularly 0.35 to 0.45 $gs^{-1}$. Especially advantageously, such a spray rate can be attained employing aerosol compositions that have a low volatile content (VOC) and amongst other alternatives enable dimethylether to be employed as propellant.

The invention spray nozzle is suitable for incorporation at one end of a spray line that terminates at its other end within the reservoir of an aerosol dispenser and incorporates a valve that can be opened or closed by an actuator. The nozzle is attached usually to a spray channel extending within the actuator. The valve can be a conventional long or short stroke in-line valve or a tilt valve. It is especially desirable to incorporate a valve that includes both a vapour phase tap (VPT), and a restricted tail piece (RPT) thereby facilitating the employment of aerosol compositions boasting a liquefied gas propellant. As a practical matter, it is often convenient for a valve that is employed with the instant invention nozzle to have a valve stem diameter of from 0.45 to 0.55 mm. Commonly, the nozzle is inserted into a spray channel contactable with and extending orthogonally to the valve stem.

The aerosol dispenser incorporating the invention spray nozzle may comprise a plastic container, in order to avoid corrosion problems, or, more commonly, metal cans, for example tin-plate or, more preferably, aluminium may be used. Lacquered cans are particularly preferred for packaging aerosol compositions. The actuator in some embodiments of the invention dispenser can conveniently comprise a button. In such embodiments, the aerosol dispenser is most desirably fitted with a removable cover for the actuator. In other embodiments that are particularly suitable for use by a consumer, a through-the-cap discharge mechanism is employed, the nozzle very conveniently being sited to discharge through an opening in the cap wall, which opening may or may not be closed or otherwise obstructed when it is desired not to effect discharge. The actuator/spray cap in which the invention spray nozzle is fitted may further comprise one or more lock mechanisms to prevent inadvertent discharge for example during transportation or to hinder discharge by children (so-called child-proof).

Aerosol products in accordance with the present invention incorporate an aerosol composition within the reservoir of the aerosol dispenser. The selection of the aerosol composition, and particularly of a cosmetic aerosol composition is at the discretion of the producer. Such compositions commonly contain a cosmetic active, a carrier fluid and a volatile propellant. A volatile propellant herein means a propellant that is gaseous at ambient pressure and 20° C.

Suitable volatile propellants for use in aerosol compositions incorporate a volatile propellant, which is typically a liquefied volatile organic compound (VOC) or mixtures thereof, and/or a compressed gas. Desirable VOCs comprise an organic hydrocarbon, hydrofluorocarbon, chlorofluorohydrocarbon or alkyl ether, having a low boiling point such as below −5° C., and especially below −15° C. Examples of such compressed gas propellants include compressed nitrogen or carbon dioxide. Examples of volatile compounds, trichlorofluoromethane, trichlorotrifluoromethane, difluoroethane, propane, butane or isobutane or combinations thereof or dimethylether. When used, the weight proportion of liquefied or compressed gas in the composition of the invention may be from 5 to 95% and preferably from 30 to 90% by weight of the composition. It is especially desirable to employ low VOC compositions in which the VOC propellant preferably contributes from 30 to 60%, more preferably from 30 to 50% by weight of the total composition.

Other ingredients which may be present in the products according to the present invention, and at the discretion of the producer, depending on the intended use of the product, and particularly the cosmetic product, can include one or more active ingredients for cosmetic use, such as a deodorant active, an antiperspirant active, a fragrance, a lacquer or other hair treatment active, or a sunscreen. The proportion of such an active in the composition is at the discretion of the producer and is generally selected in accordance with the type of active chosen. In many instances the concentration of the active is selected in the range of from 0.1% to 10% w/w of the total composition. In many instances, the concentration of the active is selected in the range of from 0.25 to 40% of the base composition, by which is meant the composition prior to addition of the propellant.

The composition can incorporate cosmetically acceptable carrier fluid components containing up to 4 carbon atoms, such as straight and branched chain alcohols, for example, ethanol, isobutanol or isopropanol. Such alcohols are particularly desirable in deodorant or body spray aerosol compositions, and desirably can represent up to 90% or even 95% w/w of the base composition. However, the alcohol is sometimes advantageously substituted by an aqueous blend, by which is meant that water constitutes at least 5% and preferably not higher than 60% of the blend. In a number of preferred blends water constitutes from 20 to 50% w/w of the blend. By incorporating water into the composition, the proportion of VOCs is accordingly reduced. It is especially desirable to employ blends containing at least 20% w/w water with dimethylether as propellant, in order to facilitate the formation of a single liquid phase.

Deodorant actives suitable for incorporation in cosmetic compositions herein can comprise deodorant active perfumes and deodorant compounds which can act as antimicrobial agents known in the cosmetic art such as antimicrobial actives such as polyhexamethylene biguanides, e.g. those available under the trade name Cosmocil™ or chlorinated aromatics, e.g. triclosan available under the trade name Irgasan™, non-microbiocidal deodorant actives such as triethylcitrate, bactericides and bacteriostats, such as aminopolycarboxylates or their acids, such as edetic acid or pentetic acid. Yet other deodorant actives can include bactericidal zinc salts such as zinc ricinoleate.

The cosmetic active can include an antiperspirant salt, and especially when in solution in an aqueous phase. In practice, the salt is an aluminium chlorohydrate, optionally complexed with glycine.

The composition can additionally include other ingredients, which even if present, typically provide no more than 5% w/w of the base composition. Such other ingredients can be selected from: — inorganic electrolytes, such as sodium chloride or sodium sulphate;

rheology modifiers, such as hydroxypropyl cellulose;

a silicone gum, such as DC 1501, ex Dow Corning; polar additives such as propylene carbonate;

additional skin feel improvers, such as talc and finely divided high molecular weight polyethylene such as Accumist B18;

humectants, such as aliphatic polyols, for example glycerol or polyethylene glycol of average molecular weight from about 200 to 500;

perfumes;

preservatives and antioxidants;

skin benefit agents such as allantoin;

colorants;

emulsifiers such as non-ionic polyalkyleneoxide polysiloxane emulsifiers and other cosmetic adjuncts conventionally employed in propellant driven aerosol products.

If particulate ingredients are contemplated, it is desirable to finely divided materials, for example having an average particle size of below 40 or 50 μm and substantially no particles above 100 μm and preferably substantially none above 75 μm where the outlet diameter is below 0.4 mm.

It is advantageous to select ingredients for inclusion in aqueous or aqueous/alcoholic or emulsion compositions contemplated herein that are soluble in water or in a low molecular weight alcohol, $C_1$ to $C_4$, or in a mixture of water and such alcohol, e.g. a solubility of at least 1% w/w and preferably at least 5% w/w, including astringent antiperspirant salts and water-soluble deodorants, the latter often being ionic employing a suitable counter-ion such as a halide to promote solubility. However, it will also be recognised that oil-soluble ingredients can be accommodated to the extent that they are soluble in the oil phase of an emulsion.

It is especially desirable for the cosmetic composition incorporated in the invention product herein to comprise a single phase aqueous alcoholic composition containing a deodorant active and dimethylether as propellant. It is preferred that the volatile propellant in such compositions is present at a level of 65% or less, more preferably 50% or less and most preferably 40% or less by weight of the total composition/spray. It is advantageous to incorporate the volatile propellant at 25% or greater, 30% or greater, or even 35% or greater by weight of the total composition/spray. In order to minimise VOC content, it is preferred that the combined content of the volatile propellant and C1-C4 monohydric alcohol is equal to 70% or less of the total composition/spray, more preferably, up to 60%, and most preferably up to 50% of the total composition. The combined content of the two ingredients is usually at least 35% and often at least 40% w/w of the composition.

By the use of the invention aerosol dispenser, the user obtains the benefit of a spray with a lower perceptible wetness, thereby enjoying a more pleasant experience. This benefit can be appreciated especially when the aerosol product comprises an aqueous composition, such as containing an aqueous alcoholic deodorant composition, ideally comprising dimethylether as propellant and particularly a low VOC composition, such as containing from 40 to 60% w/w VOCs.

Numbers disclosed herein in the brief summary and detailed description and preferred embodiments are considered to be qualified by "about" unless specifically stated to the contrary or must be unitary (such as the number of inlet channels).

Having given above a detailed description of the invention including preferred embodiments thereof, a more detailed description of particular embodiments will now be described by way of example only.

Figure 1:
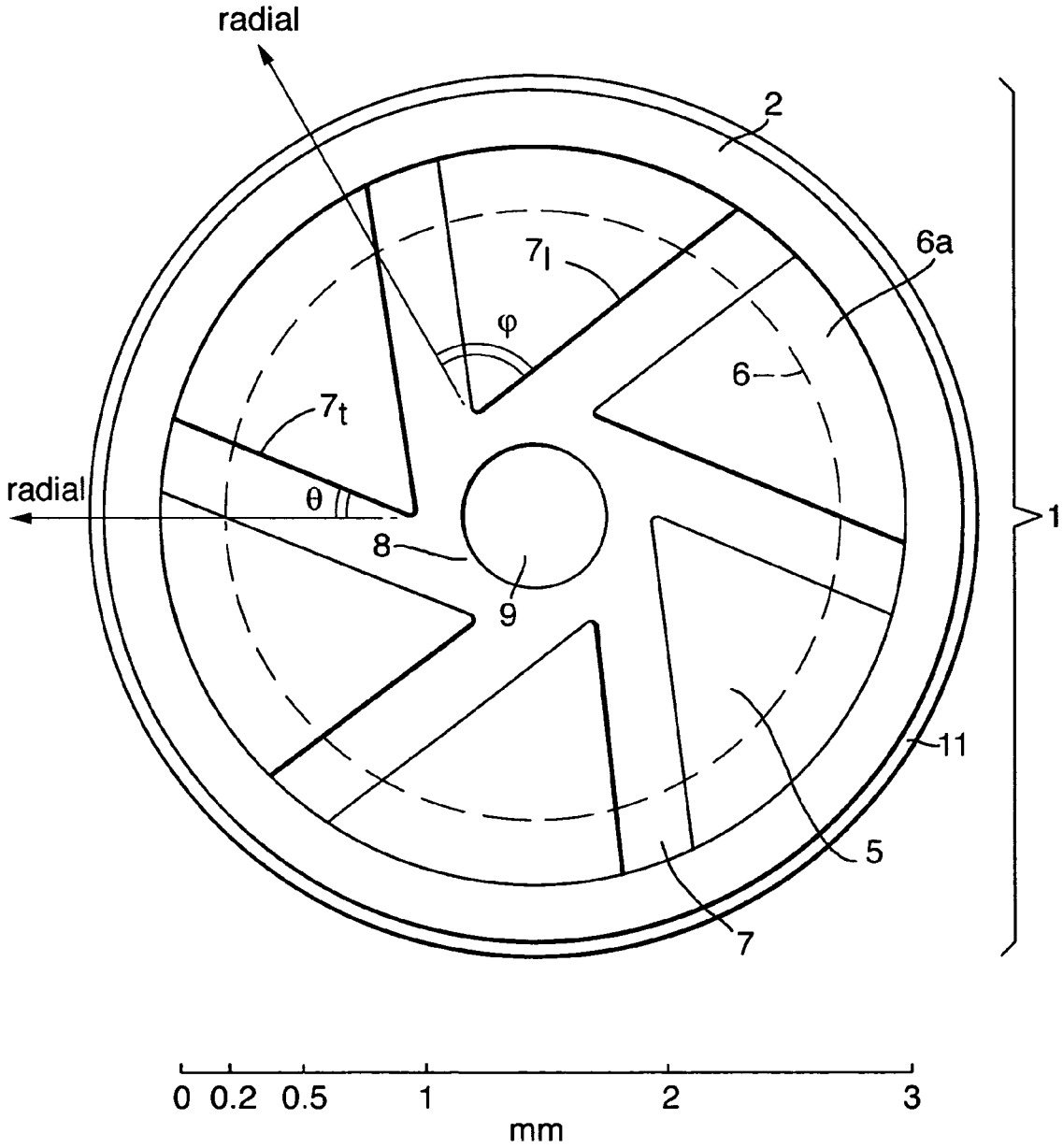
FIG. 1 shows an outward facing plan view of a conventional nozzle.
Figure 2:
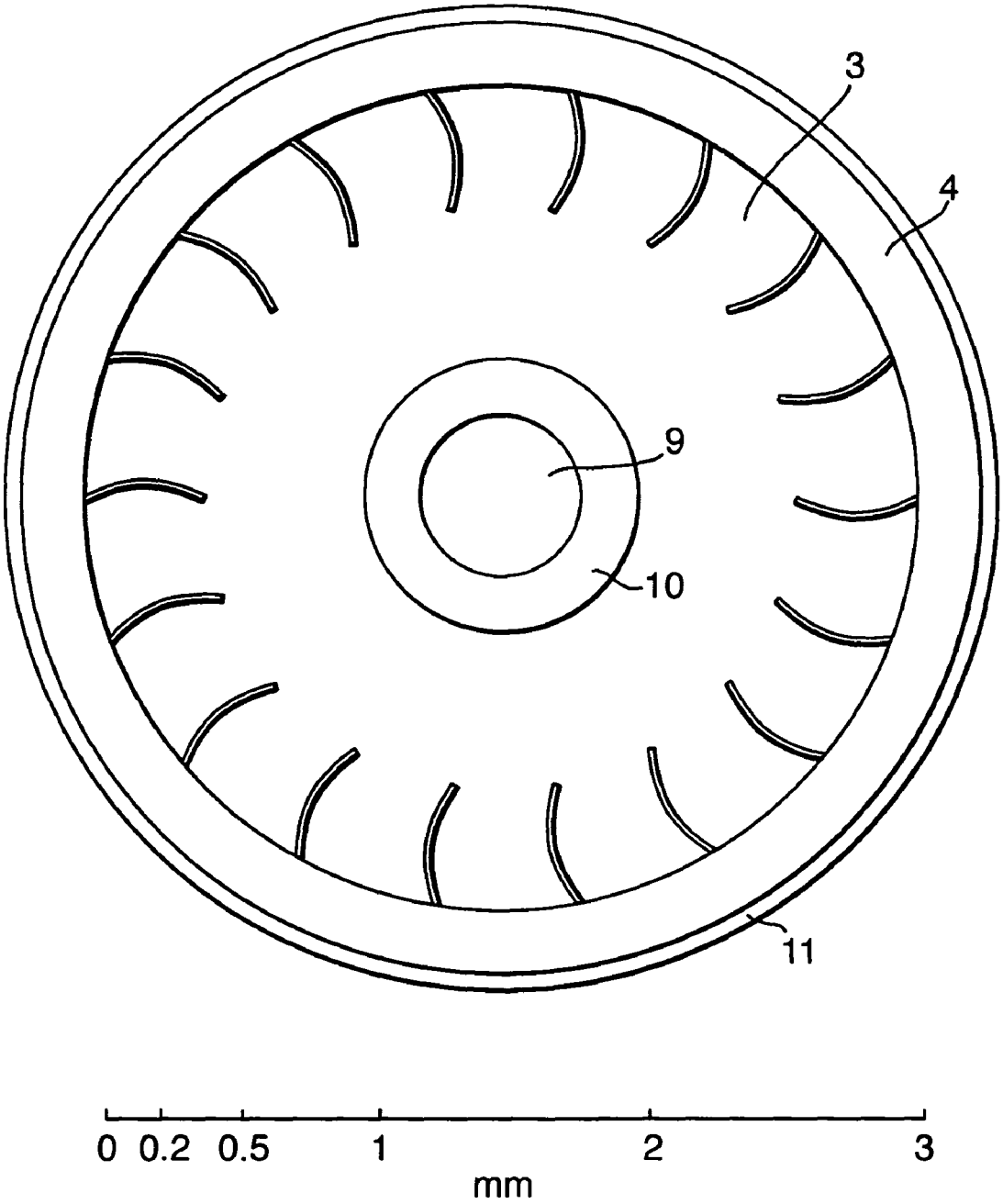
FIG. 2 shows an inward-facing plan view of the nozzle of FIG. 1.

The prior art nozzle shown in accompanying FIGS. 1 and 2 comprises a one-piece thermoplastic moulding (1) having a tubular side wall (2) terminating in an end wall (3) from which depends a circular skirt (4). The side wall (2) together with six symmetrically located upstanding lands (5) in the end wall (3) define an annular groove channel (6), the internal sidewall of which is shown by a dotted line, six tangential inlet channels (7) and a central swirl chamber (8) having a central outlet orifice (9) which projects outside the end wall (3) by tube (10). Side wall (2) has an internal diameter of 2.9 mm and the inner diameter of the annular channel was approximately 2.4 mm. The swirl chamber had a diameter of 1 mm, the inlet channels were parallel sided providing a constant width of 0.25 mm, and a radial length of 0.73 mm and were inclined non-radially, trailing side (7*t*) at an angle θ of 23° to the radius, leading side (7*l*) at an angle ϕ of about 85° to the radius and the outlet orifice a diameter of 0.6 mm. The swirl chamber and inlet channels had a depth of 0.25 mm.

Figure 3:
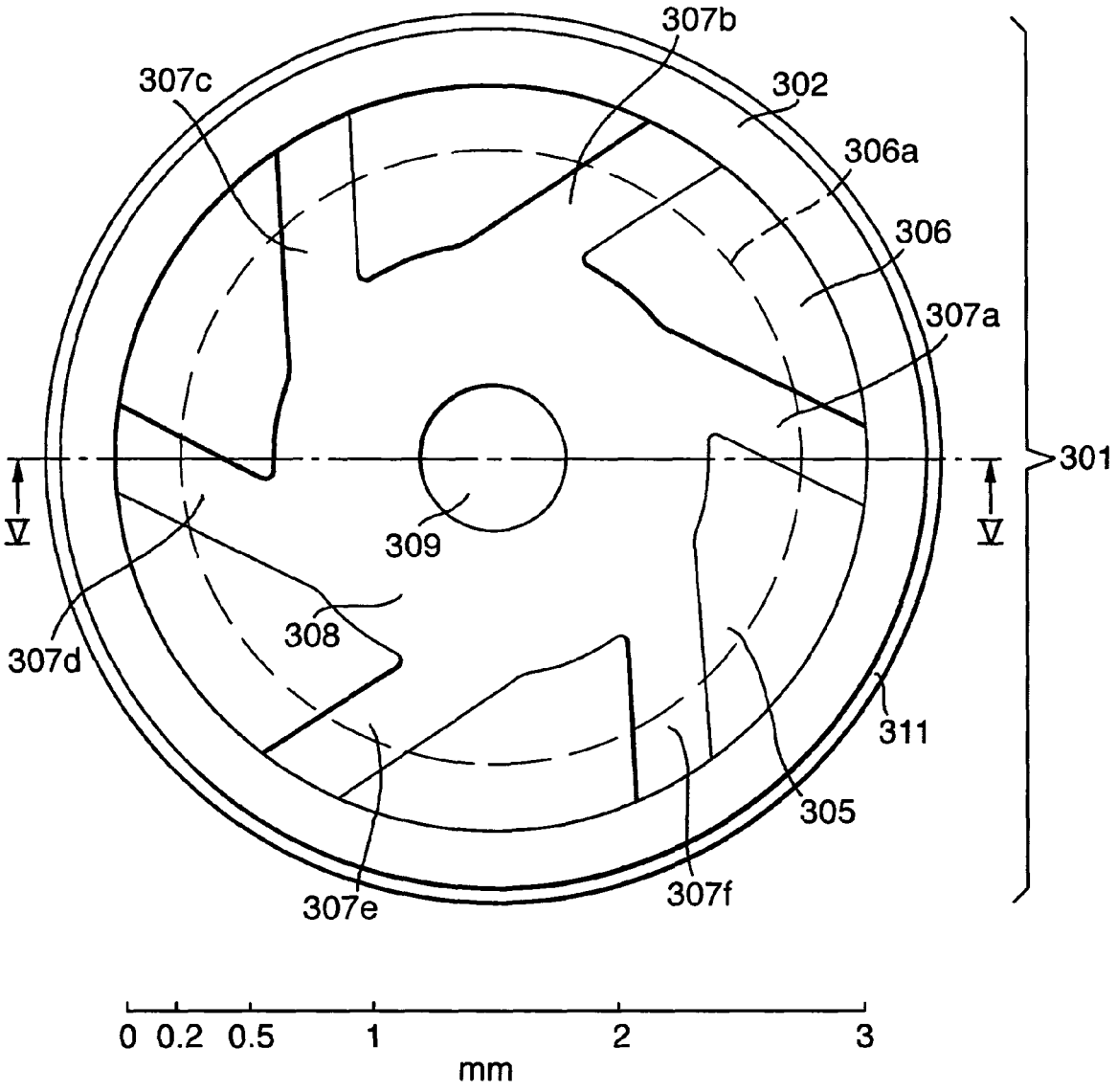
FIG. 3 shows an outward facing plan view of a nozzle according to the present invention.
Figure 4:
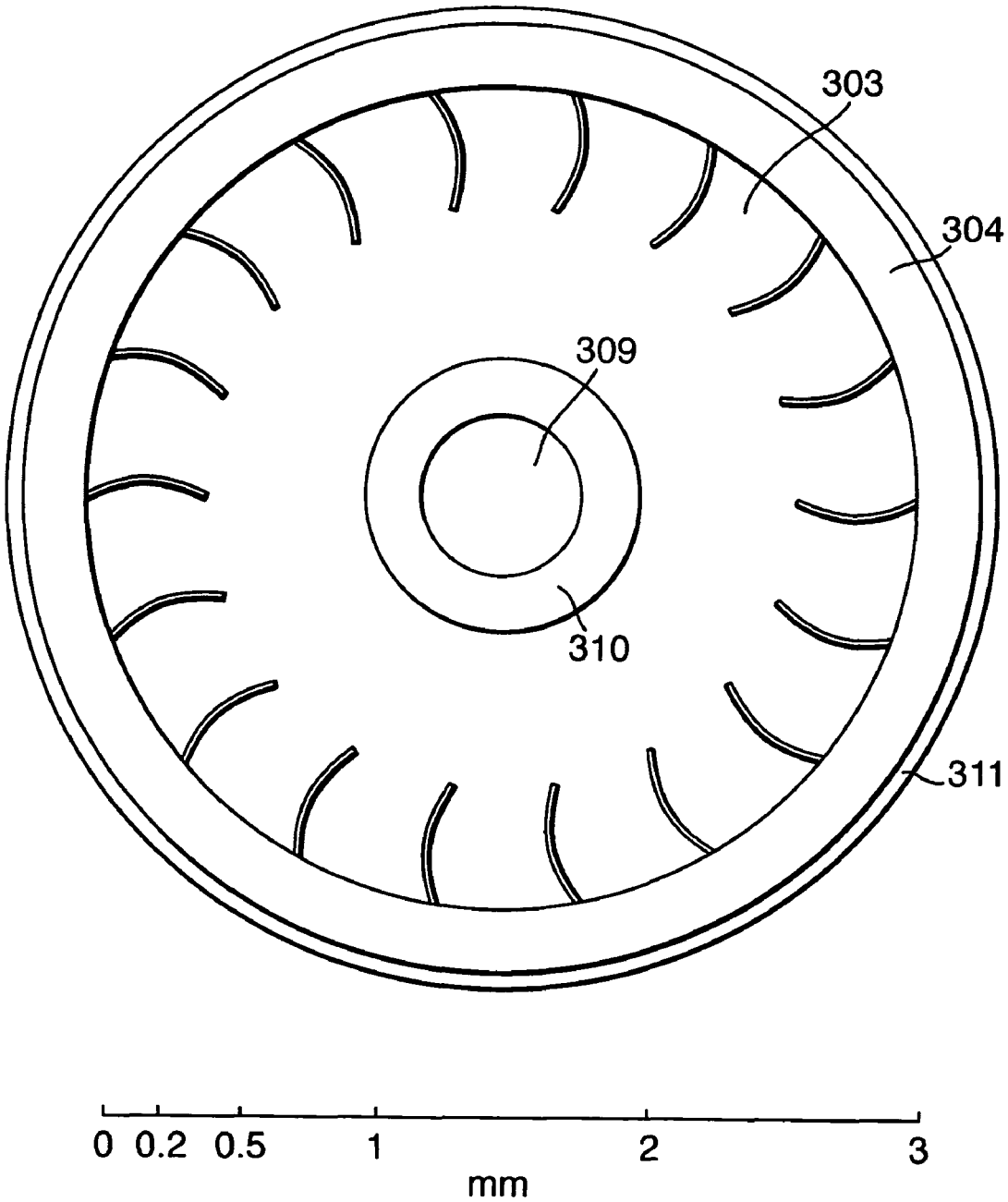
FIG. 4 shows an inward-facing plan view of the nozzle of FIG. 3.
Figure 5:
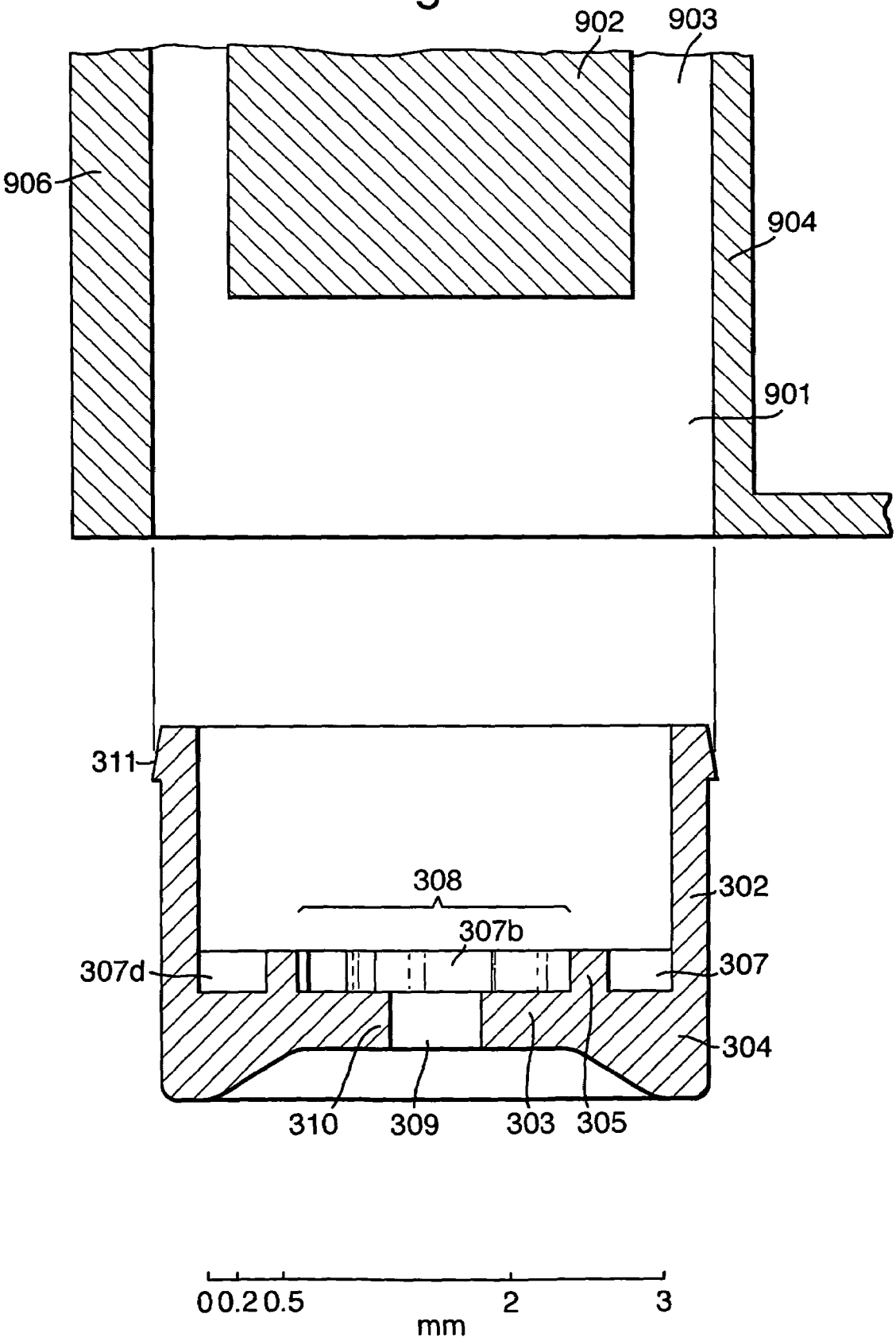
FIG. 5 shows in expanded view the nozzle of FIG. 3 in cross-section along line V-V and its relationship to a spray channel within a button actuator of FIG. 9.

The invention nozzle shown in accompanying FIGS. 3, 4 and 5 comprises a one-piece thermoplastic moulding (301) having a tubular side wall (302) terminating in an end wall (303) from which depends a circular skirt (304). The side wall (302) together with six symmetrically located upstanding lands (305) in the end wall (303) define an annular groove (26), six tangential inlet channels (307*a* to *f*) and a central swirl chamber (308) having an central outlet orifice (29) which projects outside the end wall (303) by tube (310). Side wall (302) has an internal diameter of 2.9 mm, the annular channel an internal diameter of about 2.4 mm and the swirl chamber a diameter of 2 mm. The inlet channels were parallel sided and square in cross section having a width of 0.25 mm and a radial length of 0.34 mm. They were inclined non-radially, with trailing side at an angle (θ) of 35° to the radius and leading side at an angle (ϕ) of 65° to radial. The outlet orifice had a diameter of 0.6 mm. The swirl chamber and inlet channels had a depth of 0.25 mm provided by abutment of the nozzle with a central, axially extending peg located within the spray channel into which the nozzle is inserted.

The nozzle of FIGS. 3 and 5 is inserted pneumatically into and retained by friction in a spray channel (901) of an actuator until its lands (305) between inlet channels (307) physically about an axially extending central peg (502) in the spray channel (501) that defines with wall (904) an annular channel in fluid communication with an annular channel (306) defined by the peg (902) and the sidewall (302) of the nozzle (301). Likewise, the central peg 902 provides the inward face of the swirl chamber (308) and inlet channels (307). Friction is assisted by an external rib (311) projecting radially outwardly from the sidewall (302) of the nozzle (301). The location of the peg is indicated in FIG. 3 by a dotted line.

Figure 6:
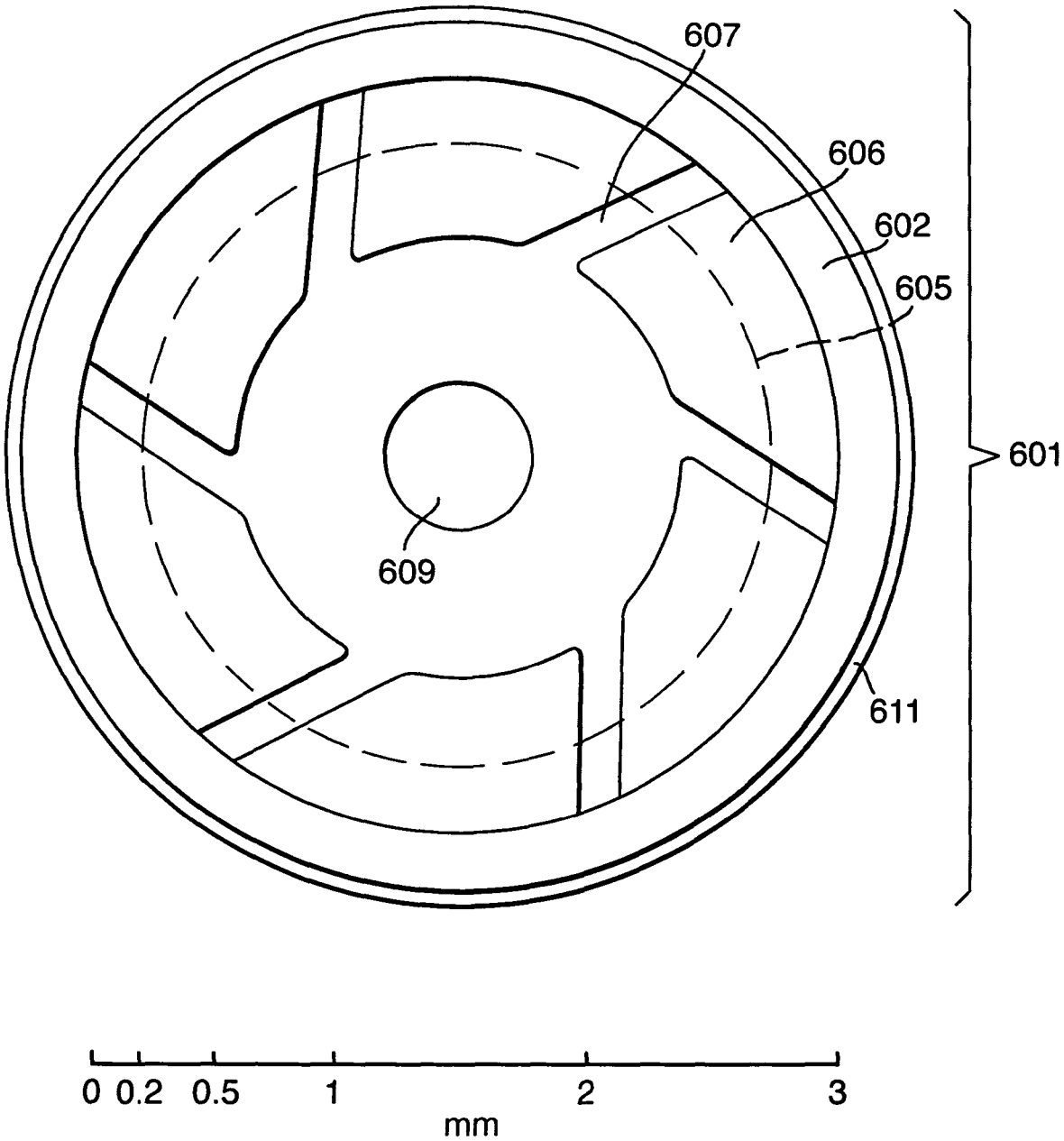
FIG. 6 shows an inward facing plan view of an alternative nozzle having narrow inlet channels but otherwise the same as in FIG. 3.

The invention nozzle shown in FIG. 6 is the same as that of FIGS. 3 to 5, except that the parallel sided inlet channels (607) had a rectangular cross section provided by a width of 0.12 mm and a depth of 0.25 mm. The inlet channel leading side was inclined at an angle $\phi$ of 60° to the radius.

Figure 7:
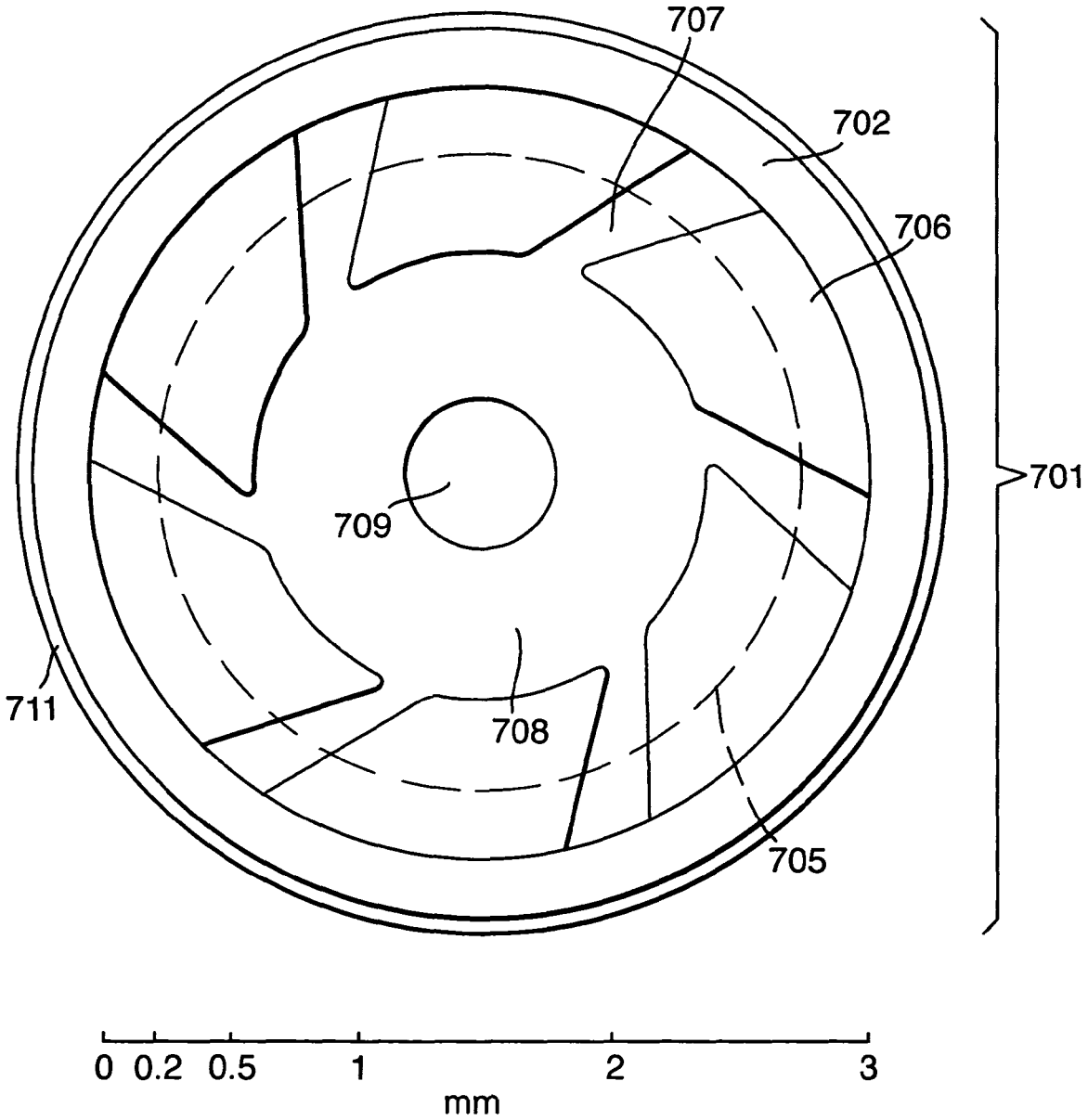
FIG. 7 shows an inward facing plan view of an alternative nozzle having narrow inlet channels but otherwise the same as in FIG. 3.

The invention nozzle shown in FIG. 7 is the same as that of FIGS. 3 to 5 except that the inlet channels (707) had flat sidewalls tapered inwardly and evenly from a width of 0.25 mm at the inner periphery of the annular channel to a width of 0.12 mm at the corner of the trailing sidewall with the swirl chamber. The inlet channel had inclined trailing and leading sides, both of 47° to the radius.

Figure 8:
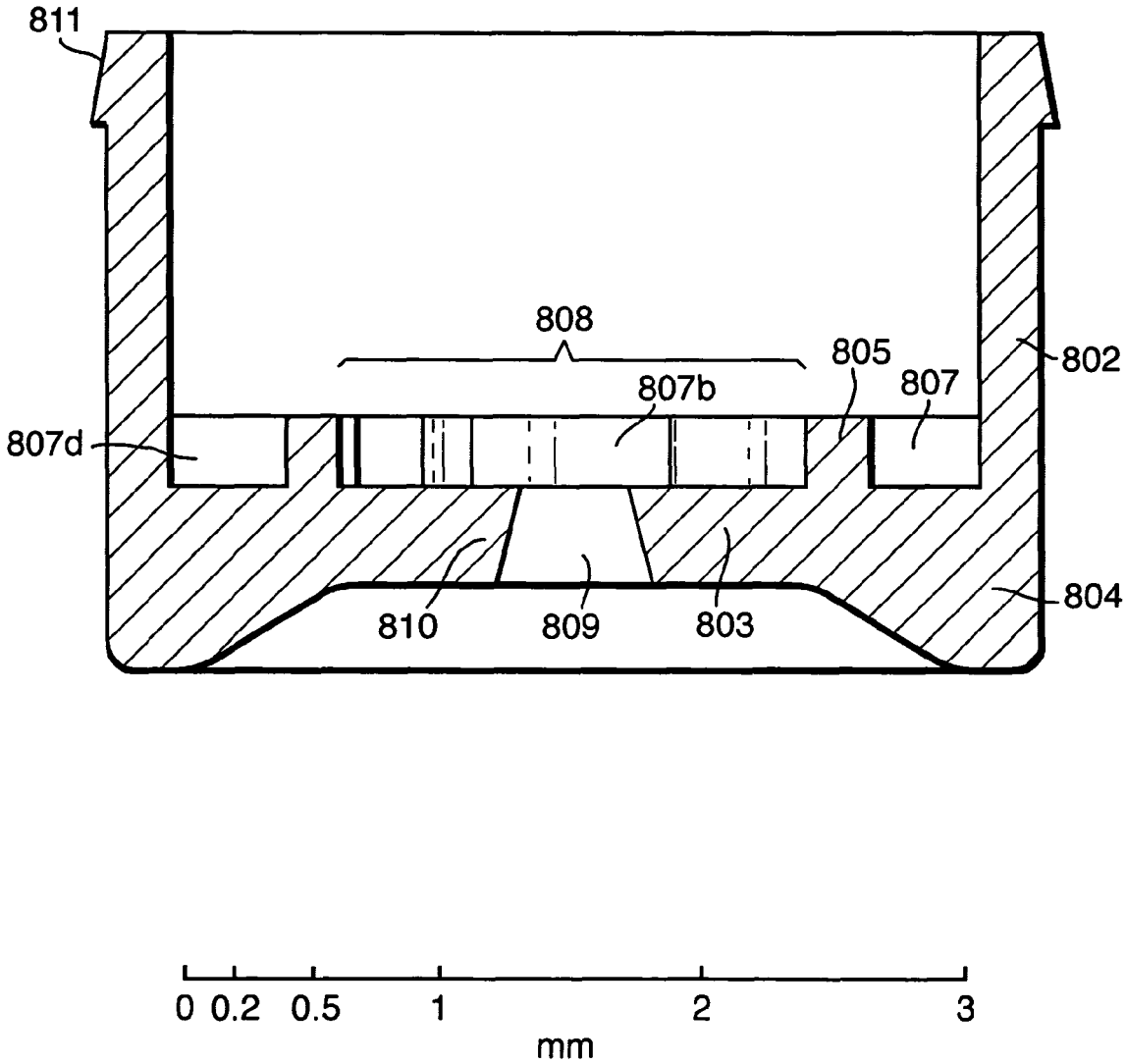
FIG. 8 shows an outward facing plan view of an alternative nozzle having a frustoconical outlet, but otherwise the same as in FIG. 3.
Figure 9:
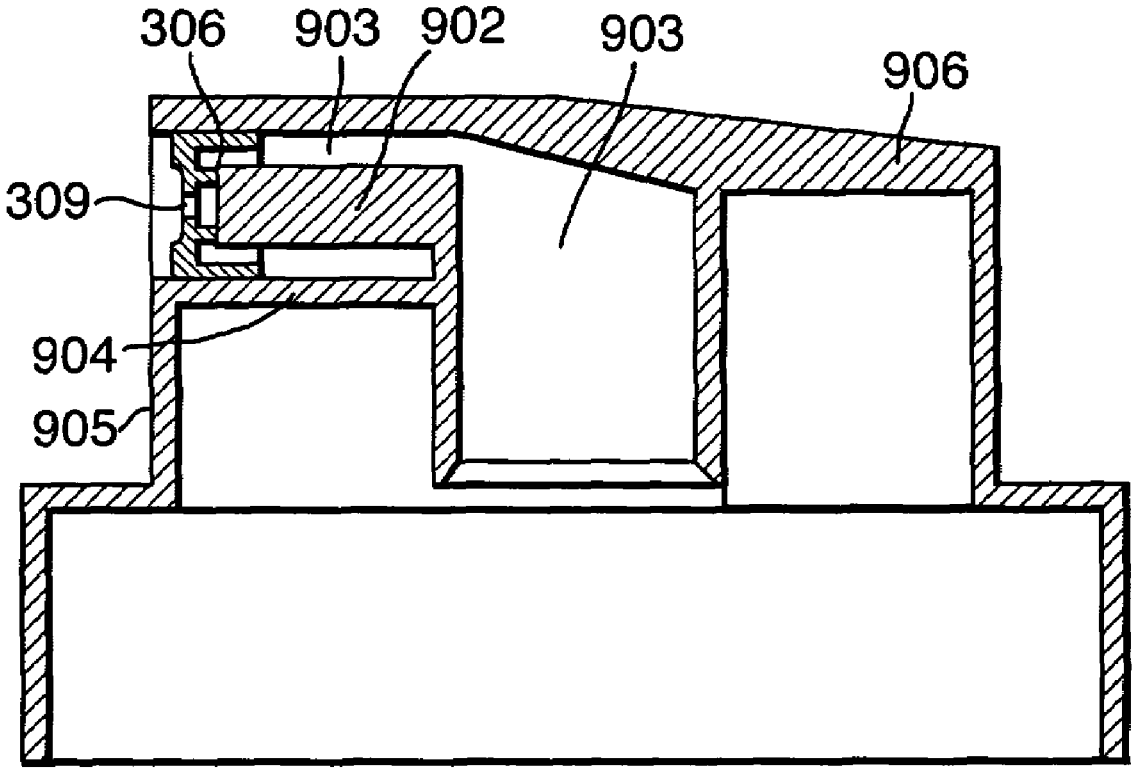
FIG. 9 shows in cross section, a button actuator in which the nozzles of FIG. 3, 6, 7 or 8 can be mounted.

The invention nozzle shown in FIG. 8 is the same as that of FIGS. 3 to 5 except that the outlet orifice (809) was frusto-conical, its diameter increasing evenly from 0.4 mm at its tip to 0.6 mm where it communicates with the swirl chamber along a length of 0.35 mm.

The invention nozzle (301) is mounted in the spray channel (901) of a button actuator by friction fit, the annular channel (903) communicating orthogonally with a down tube (903) that is mounted on a valve stem (not illustrated). The button further comprises a top wall (906) which can be depressed to open the valve and a side wall that typically fits within a valve cup rim (not illustrated) of an aerosol container (also not illustrated).

Figure 10:
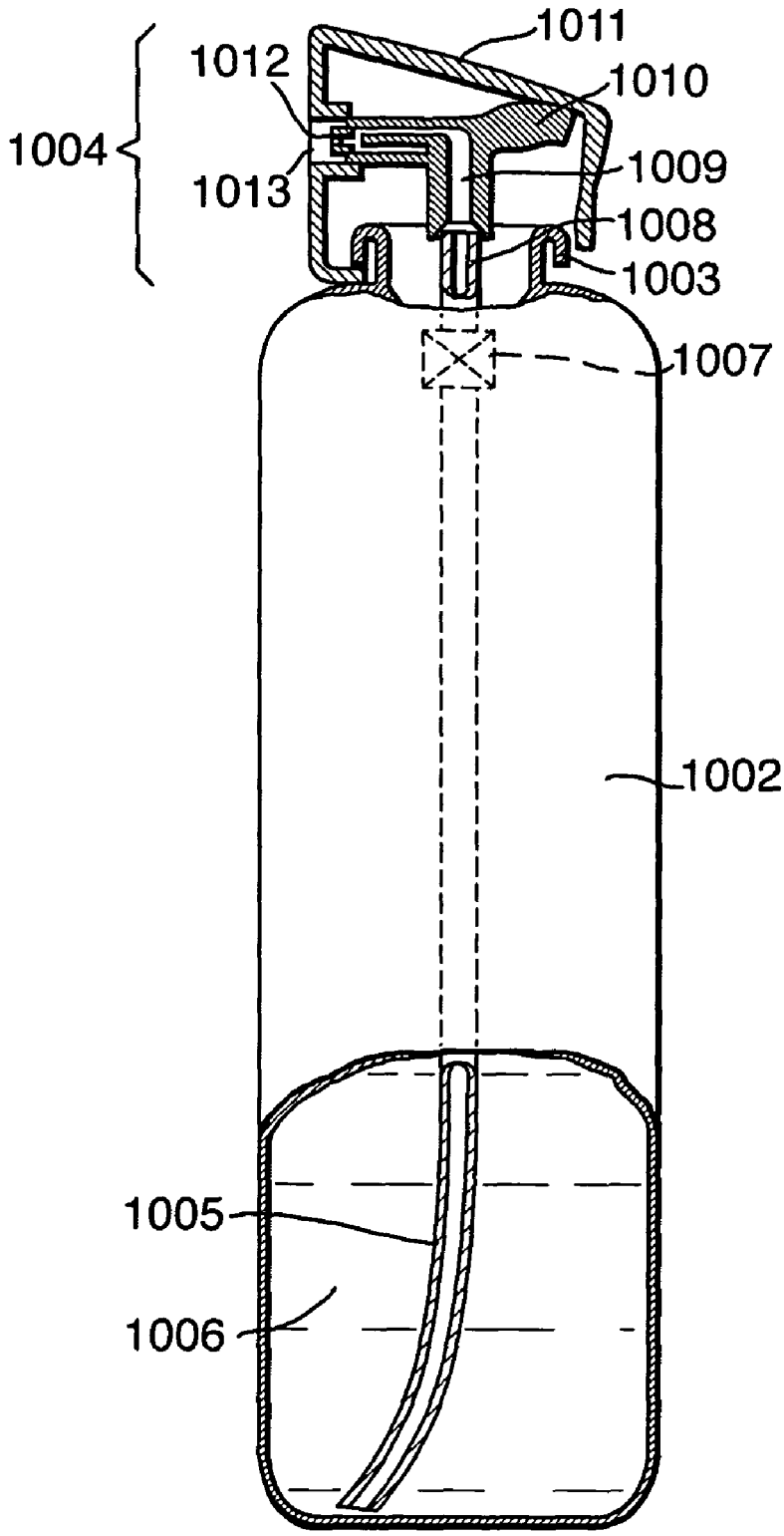
FIG. 10 shows schematically in partial cross section a filled aerosol employing a through the cap actuator in which the nozzle of FIG. 3 is mounted.
Figure 11:
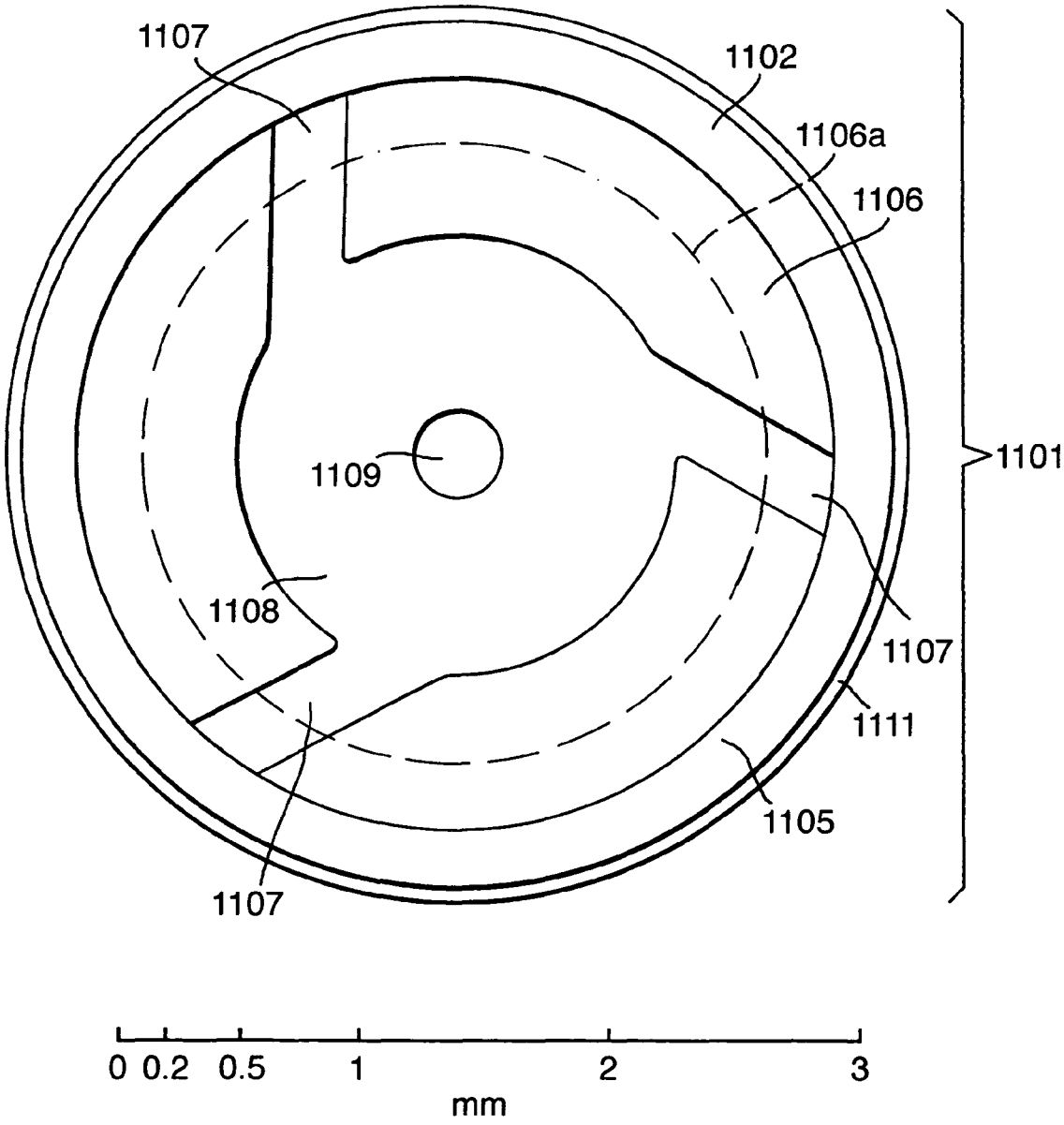
FIG. 11 shows an alternative nozzle with 3 inlet channels.
Figure 12:
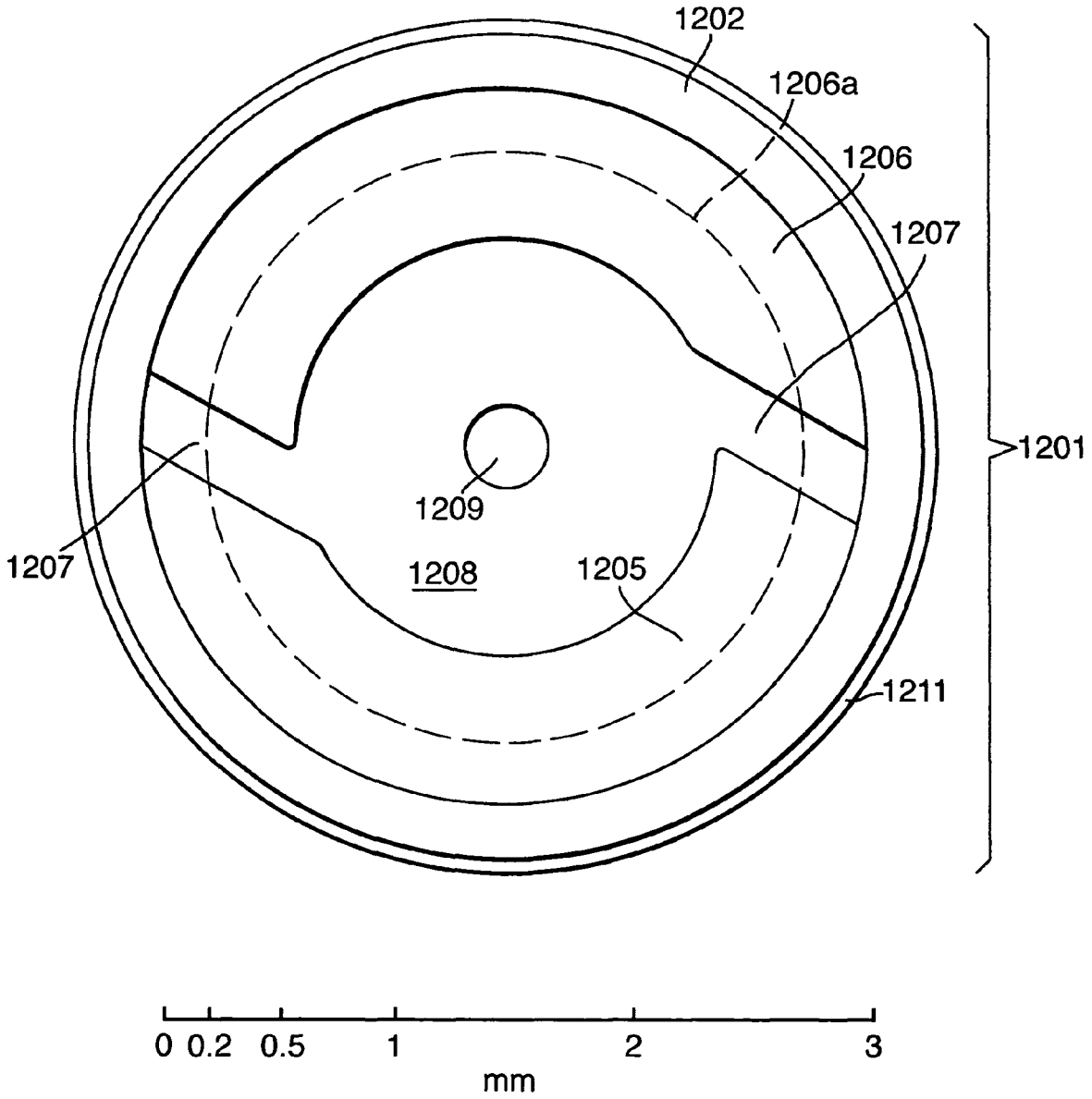
FIG. 12 shows an alternative nozzle with 2 inlet nozzles.

The filled aerosol product shown in FIG. 10 comprises a blow moulded aluminium bottle (1002) fitted with a valve cup (1003) over which is fitted an overcap (1004). A dip tube (1005) dipping into a deodorant formulation (1006) extends from a valve (1007) (shown schematically) from which a valve stem (1008) projects through the valve cup (1003) and is capable of engaging with a spray channel (1009) in an actuator (110) by depression of the top wall (1011) of the overcap (1004). The actuator is intrinsically moulded with the overcap (1004). A nozzle (1012) as shown in FIGS. 3 to 5 is inserted into the actuator (1010)) at the end of the spray channel (1009) remote from the valve stem (1008), projecting through a window (1013) in the overcap (1004) front wall.

The alternative nozzle (1101) comprises elements that are the same as the corresponding elements in nozzle (301) except that only three inlet channels are employed and the outlet orifice has a diameter of 0.35 mm. The inlet channel trailing side was inclined at an angle $\theta$ of 28° to the radius and its leading side at an angle $\phi$ of 58°.

The alternative nozzle (1201) comprises elements that are the same as the corresponding elements in nozzle (301) except that only two inlet channels (1207) are employed of width 0.30 mm and the outlet orifice has a diameter of 0.3 mm. The inlet channel trailing side was inclined at an angle $\theta$ of 30° to the radius and its leading side at an angle $\phi$ of 58°.

EXAMPLE 1 AND COMPARISON A

In Example 1, a 150 mls aerosol dispenser in accordance with FIG. 10 and fitted with a valve K125 RA 190/6/6 available from Coster Technologie Spa was filled with a deodorant formulation consisting of: —

| Ingredient | % by weight of the composition | |
|---|---|---|
| Dimethylether | 45 | |
| DEB 100 | 15 | Ethanol |
| Water | 36.5 | |
| Cremophor RH410 | 1.5 | PEG-40 hydrogenated castor oil |
| Fragrance | 1.5 | |
| Cosmocil CQ | 0.5 | Polyaminopropyl biguanide |

The comparison aerosol product was identical except that the nozzle was that shown in FIGS. 1 and 2.

A panel of experienced, trained female panellists aged between 18 and 50 numbering 30 tested the two products by spraying one product onto one underarm and the other on to the other underarm from a distance of 15 cms and in a random distribution of products to the left or right underarm. The average weight of application was 0.79 g for the comparison product and 0.77 g for the product employing the invention nozzle. The panellists recorded their perception of which of the products was wetter, on application, after 1 minute and after 2 minutes, based on a scale of from 1 to 4 in which 1 represents just noticeable, 2 represents slight, 3 represents moderate and 4 represents extreme. The results were averaged and the significance of the difference calculated using a Wilcoxon Signed Rank test. The significance level is obtained from the formula $(1-p)\times 100$.

| Test | Which wetter? | Average Difference | P value | Significance level |
|---|---|---|---|---|
| On application | Comparison | 0.8 | 0.0400 | >95% level |
| After 1 min | Comparison | 1.5 | 0.0015 | >99% level |
| After 2 mins | Comparison | 1.1 | 0.0063 | >99% level |

The product sprayed through the invention nozzle was perceived as being significantly less wet, not only on immediate application but to an even greater extent during the drying phase of the product.

EXAMPLE 2 AND COMPARISONS B AND C

In this Example and Comparisons, an extended consumer trial was conducted in which 220 male panellists aged between 18 and 54 tested over a period of two weeks matched pairs of products blind, one to one armpit and another to the other (left-right assigned randomly but balanced numbers for each pair) and assessed which of the products had the wetter feel on application. Overall, each product was sprayed onto the same number of left and right armpits. All the three products employed the same aerosol composition, as described for Example 1, except that Comparison C included 1.8% fragrance, (i.e. 0.3% less water) and the valves were selected so that Example 2 and Comparison B sprayed at the same spray rate of 0.6 g/s, thereby eliminating the possibility that a difference in perception between those two products was attributable to different spray rates. The spray rate of Comparison C was 0.39 g/s. The wetness of each product was assessed by the user on a 7 point scale, in which 1 was the wettest and 7 was the least wet. The scores for each product were averaged and the statistical significance of the differences assessed by the Annova F test, and as between two products, p=0.024.

The dispensers were as follows: —

Example 2—Valve K1 RA 190/6/6 with VPT of 0.6 and RPT 0.6; Nozzle according to FIG. 3

Comparison B—Valve K1 RA 190/5/8 with VPT of 0.5 and RPT 0.8; Nozzle V06.269

Comparison C—Valve K1 RA 190/6/6 with VPT of 0.6 and RPT 0.6; Nozzle V04.239

The results showed that the average score for Example 2 was 4.8, that for Comparison B was 4.22 and for Comparison C was 4.34. The difference of 0.58 as regards perceived wetness between Example 2 and Comparison B is statistically significant to greater than the 95% confidence limit, in favour of Example 2. The difference of 0.46 as regards perceived wetness between Example 2 and Comparison C is likewise statistically significant to greater than the 95% confidence limit, in favour of Example 2, and shows that the improvement was significantly greater than that which was achieved by reducing the spray rate.

The invention claimed is:

1. An aerosol product comprising a sprayable fluid comprising a cosmetic composition contained within a reservoir of an aerosol dispenser, a spray nozzle comprising a swirl chamber in fluid communication with a plurality of non-radial inlet channels and an outlet orifice, which outlet orifice has a diameter of at least 0.3 mm, the sum of the widths of the inlet channels at its trailing side on entry into the swirl chamber is less than the diameter of the swirl chamber and at least 1.5 times the diameter of the outlet orifice, and the radial length of the inlet channel is from 2:5 to 2:15 the diameter of the swirl chamber, a valve in fluid communication with the reservoir, and an actuator for the valve, wherein the aerosol product includes propellant which is liquefied volatile organic compound, and wherein the cosmetic composition comprises one or more active ingredients for cosmetic use, a cosmetically acceptable C1-C4 monohydric alcohol, and water; wherein water constitutes from 20 to 60% w/w of the alcohol and water combined, and wherein prior to the addition of propellant, the cosmetic composition comprises from 0.25 to 40% by weight of cosmetic active.

2. The aerosol product according to claim 1 in which the swirl chamber and outlet orifice have diameters in a ratio of from 3:1 to 10:1.

3. The aerosol product according to claim 1 in which the outlet orifice has a diameter of from 0.3 to 0.65 mm.

4. The aerosol product according to claim 1 in which the swirl chamber has a diameter of greater than 1 mm, and each channel has a width of at least 0.12 mm.

5. The aerosol product according to claim 1 in which the radial length of the inlet channels and the diameter of the swirl chamber diameter is selected in a ratio of from 1:3 to 2:13.

6. The aerosol product according to claim 1 in which the radial length of the inlet channels is from 0.25 to 0.5 mm.

7. The aerosol product according to claim 1 in which at least one of the inlet channels tapers towards the swirl chamber.

8. The aerosol product according to claim 1 in which the diameter of the swirl chamber is from 1.25 to 2.5 mm.

9. The aerosol product according to claim 8 in which the diameter of the swirl chamber is from 1.75 to 2.25 mm.

10. The aerosol product according to claim 1 in which each inlet channel has a width of from 0.125 mm to 0.25 mm on entry into the swirl chamber.

11. The aerosol product according to claim 1 in which the inlet channels' width tapers by 20 to 60% towards the swirl chamber.

12. The aerosol product according to claim 11 in which the inlet channels' width tapers by 33 to 50%.

13. The aerosol product according to claim 1 in which there are 2 to 6 inlet channels.

14. The aerosol product according to claim 12 in which there are 4 to 6 inlet channels.

15. The aerosol product according to claim 14 in which the diameter of the outlet orifice is from 0.4 to 0.6 mm.

16. The aerosol product according to claim 13 in which there are 2 or 3 inlet channels and the outlet orifice has a diameter of up to 0.45 mm.

17. The aerosol product according to claim 16 in which the diameter of the outlet orifice is from 0.3 to 0.39 mm.

18. The aerosol product according to claim 1 in which the ratio of the total width of inlet channels to the diameter of the outlet orifice is in the range of from 3.75:1 to 1.5:1.

19. The aerosol product according to claim 1 in which the outlet orifice is inwardly frustoconical.

20. The aerosol product according to claim 19 in which the outlet orifice has a cone angle of less than 40°.

21. The aerosol product according to claim 18 in which the outlet orifice has a cone angle of 30 to 36°.

22. The aerosol product according to claim 1 in which the swirl chamber and inlet channels depth are defined by a one-piece moulding having tubular wall having an internal diameter of from 3 to 4 mm closed at one end by an indented end wall that abuts a peg in an actuator channel.

23. The aerosol product according to claim 22 in which the tubular wall has an internal diameter of from 3.33 to 3.7 mm.

24. The aerosol product according to claim 22 in which the internal diameter of the tubular wall and the diameter of the swirl chamber are in a ratio of from 1.5:1 to 2:1.

25. The aerosol product according to claim 22 in which the moulding is injection moulded from a thermoplastic material.

26. The aerosol product according to claim 1 in which the sprayable fluid comprises dimethyl ether as propellant.

27. The aerosol product according to claim 1 that provides the sprayable fluid with a flow rate of from 0.3 to 0.8 $gs^{-1}$.

28. The aerosol product according to claim 27 that provides the sprayable fluid with a flow rate of from 0.35 to 0.45 $gs^{-1}$.

29. The aerosol product according to claim 1 in which the radial length of the inlet channels and the diameter of the swirl chamber are selected in a ratio of from 14 to 1:6.

30. The aerosol product according to claim 1 in which the radial length of the inlet channels is from 0.3 to 0.4 mm.

31. The aerosol product according to claim 1 wherein the cosmetic active includes one or more ingredients selected from the group consisting of deodorant active, antiperspirant active, fragrance, hair treatment active and sunscreen.

32. The aerosol product according to claim 1 wherein the cosmetic composition is a deodorant composition.

* * * * *